US007105789B2

(12) United States Patent
Ekemar

(10) Patent No.: US 7,105,789 B2
(45) Date of Patent: Sep. 12, 2006

(54) APPLIANCE FOR THE EQUALIZATION OF HEAT IN A DIELECTRIC LOAD HEATED BY AN OSCILLATING ELECTRIC/ELECTROMAGNETIC FIELD

(76) Inventor: Lars S. E. Ekemar, Dagagatan 17, S-64632 Gnesta (SE)

( * ) Notice: Subject to any disclaimer, the term of this patent is extended or adjusted under 35 U.S.C. 154(b) by 456 days.

(21) Appl. No.: 10/451,971

(22) PCT Filed: Jan. 8, 2002

(86) PCT No.: PCT/SE02/00016

§ 371 (c)(1),
(2), (4) Date: Jun. 27, 2003

(87) PCT Pub. No.: WO02/054833

PCT Pub. Date: Jul. 11, 2002

(65) Prior Publication Data

US 2004/0045958 A1 Mar. 11, 2004

(30) Foreign Application Priority Data

Jan. 8, 2001 (SE) ..... 0100051

(51) Int. Cl.
*H05B 6/80* (2006.01)

(52) U.S. Cl. ..... 219/764; 219/687

(58) Field of Classification Search ..... 219/764, 219/762, 757, 687, 696, 703, 709, 710, 711, 219/712, 718, 628–630, 678–679, 690–692; 604/748, 113, 114, 20, 27, 48, 65; 607/98–103
See application file for complete search history.

(56) References Cited

U.S. PATENT DOCUMENTS

| | | | | |
|---|---|---|---|---|
| 2,612,596 | A * | 9/1952 | Gross | 219/762 |
| 2,856,497 | A * | 10/1958 | Rudenberg | 219/696 |
| 3,845,270 | A * | 10/1974 | Widugris, Jr. | 219/757 |
| 4,167,663 | A | 9/1979 | Granzow | |
| 4,801,777 | A * | 1/1989 | Auerbach | 219/687 |
| 5,512,737 | A | 4/1996 | Miklos | |
| 5,616,268 | A * | 4/1997 | Carr | 219/687 |
| 5,886,081 | A | 3/1999 | Sternowski | |

FOREIGN PATENT DOCUMENTS

| | | |
|---|---|---|
| EP | 0085319 | 1/1983 |
| WO | 9926690 | 6/1999 |

* cited by examiner

*Primary Examiner*—Quang Van
(74) *Attorney, Agent, or Firm*—Fildes & Outland, P.C.

(57) ABSTRACT

An appliance for the control/equalization of electric and/or electromagnetic fields being below 900 MHz, where the field/s is/are not generated in a resonant cavity. The appliance includes a dielectric load placed in a dielectric material/s. An average dielectricity constant of this material/s, at applied frequency/ies, exceeds 20% of an average dielectricity constant of the load. Additionally, a loss factor of this material/s, at the applied frequency/ies, is below 75% of an average loss factor of the load. At least 20% of a surface of the load adjoins and is in contact with the mentioned dielectric material/s. In an alternative exemplary embodiment of the invention the load includes a bag/container of blood.

19 Claims, 1 Drawing Sheet

APPLIANCE FOR THE EQUALIZATION OF HEAT IN A DIELECTRIC LOAD HEATED BY AN OSCILLATING ELECTRIC/ELECTROMAGNETIC FIELD

BACKGROUND OF THE INVENTION

It is well known that dielectric matters can be heated by oscillating electric and/or electromagnetic fields. Microwaves, which are generated in a resonant cavity, are the most frequently used kinds of fields. As a rule micro waves are defined as electric/electromagnetic fields oscillating at frequencies exceeding 900 MHz, still better at frequencies exceeding 400 MHz and best of all at frequencies exceeding 300 MHz.

The disadvantage of microwaves is that the heating usually takes place ia a surface zone, where the energy is focused to so called hot spots.

Oscillating electric/electromagnetic fields at frequencies below microwave frequencies are generally generated between two capacitor discs. Dielectric matters are placed in the air space between the discs, It is of frequent occurrence that heating between capacitor discs is disturbed by the formation of sparks.

This can be avoided by coating the capacitor discs with electrically isolating materials having small values on their dielectricity constant and loss factors implying no or little influence on the electric field. Simultaneously the isolating material shall be characterised by a high electric penetration resistance (EP 85319, U.S. Pat. No. 551,273)

It is also known that the addition of dielectric substances influences the dielectric properties of the load, which is to be heated. (U.S. Pat. No. 5,886,081, U.S. Pat. No. 4,790,965)

A drawback tied to dielectric heating is that the field lines are concentrated to relatively defined areas of the load so that these areas become unequally heated, which implies local heat concentration as a consequence. Especially this is valid, if the load has marked edges and/or protrusive parts. Thus there is a serious problem, if the load to be warmed is perishable to any kind of overheating. An example representing a living matter is a concentrate of red blood cells kept in a bag and meant for intravenous transfusion.

Methods designed for a slow warming of blood have been developed partly by utilising convection. (U.S. Pat. No. 4,167,663) and by partly by utilising microwaves, which at low power warm blood in the course of a transfusion (WO 9926690). The power, which is applied to the warming of blood in accordance to WO 9926690, is so low, that the problem tied to an uneven field distribution is negligible. However methods suitable for the fast warming of perishable loads are lacking.

Bags holding red blood cell concentrates to be used for intravenous transfusion are in general stored in refrigerators at 4° C. Two problems exist as a consequence of this temperature as a blood concentrate is viscous and cold.

It takes long time to get it out of a bag. Thus a blood transfusion will be retarded Before a blood concentrate is transfused intravenously to a patient it has to be warmed, best of all to body temperature. At acute transfusion occasions, efforts are tried to attain rapid warming of bags holding blood concentrate, in general with water-baths. Such a warming process is in spite of all pains time wasting and as a consequence patients do not receive their transfusions in due course of time.

If for example a patient is in a state if chock owing to an accident, a cooling caused by the transfusion entails a danger of life of the patient.

Experiments implying the rapid warming of bags with blood concentrates by applying micro waves as well as traditional capacitive warming have caused local overheating damages, particularly in surface zones and comers. These damages have occurred in form of coagulated blood parts and have had as consequences that patients have died owing to clots of blood.

SUMMARY OF THE INVENTION

The present invention provides a dielectric load having both a dielectric constant and a loss factor, being wholly or partly covered with a material, which merely has a dielectric constant.

An exemplary embodiment of the present invention includes an appliance for the control/equalisation of electric and/or electromagnetic fields being below 900 MHz, where the field/s is/are not generated in a resonant cavity. The appliance includes a dielectric load placed in a dielectric material/s. An average dielectricity constant of this material/s, at applied frequency/ies, exceeds 20% of an average dielectricity constant of the load. Additionally, a loss factor of this material/s, at the applied frequency/ies, is below 75% of an average loss factor of the load. At least 20% of a surface of the load adjoins and is in contact with the mentioned dielectric material/s. In an alternative exemplary embodiment of the invention the load includes a bag/container of blood.

These and other features and advantages of the invention will be more fully understood from the following detailed description of the invention taken together with the accompanying drawings.

DETAILED DESCRIPTION OF THE INVENTION

When dielectric heating is used, this invention is a solution of the problem with overheating in surface zones and protruding parts.

Figure 1:
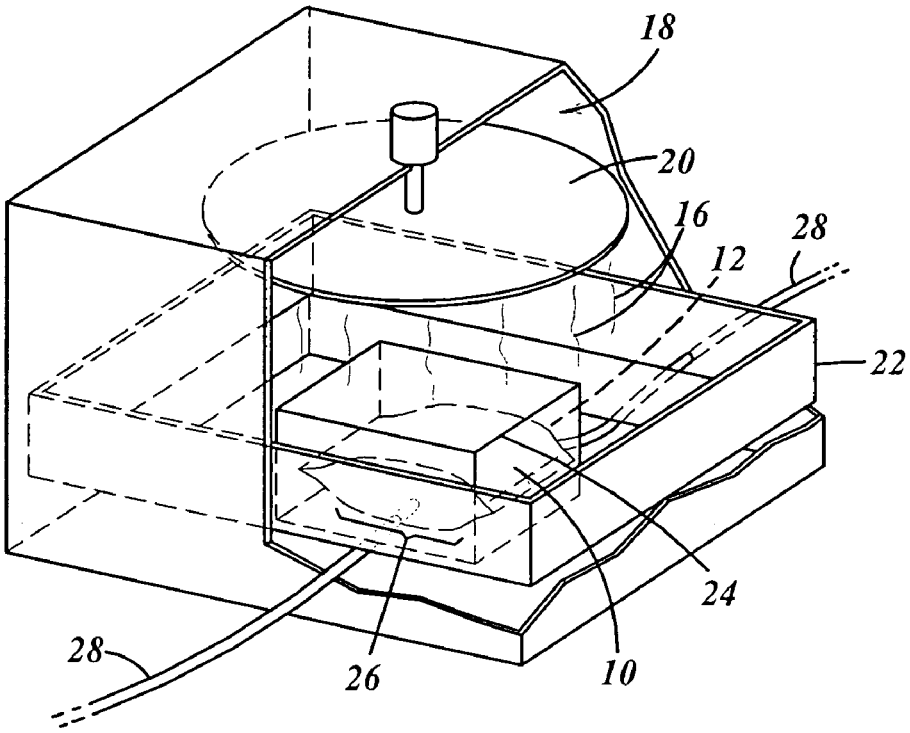
FIG. 1 is schematic perspective view diagram of an exemplary embodiment of an appliance in accordance with the present invention.
Figure 2:
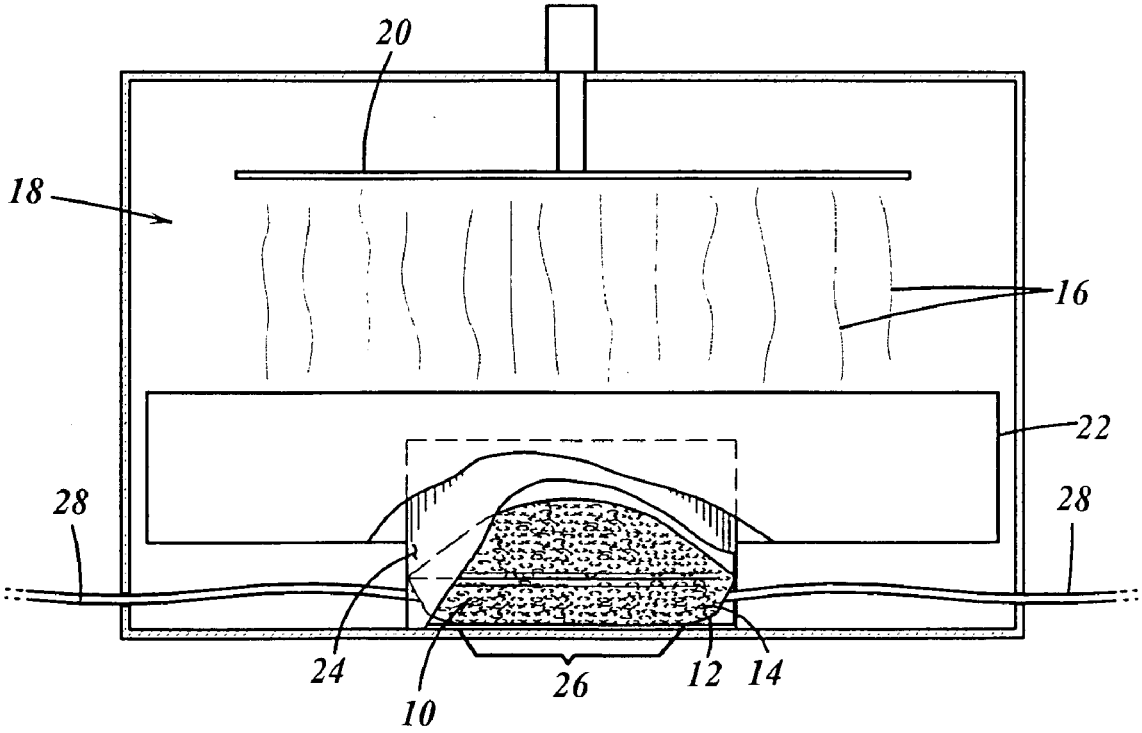
FIG. 2 is a schematic side view diagram of the appliance of FIG. 1.

Referring to FIGS. 1 and 2, this is particularly valid if the load 10, e.g. a bag 12 filled with blood 14, is placed in an oscillating electric/and or electromagnetic field 16 being below a micro wave frequency and if the load 10 is placed in a cavity 18, which is not resonant or does not becomes resonant owing to the fact it is wholly or partially filled with dielectric matters. The cavity contains an antenna 20 and a field equalizer 22 to generate the field 16 at an applied frequency. The applied frequency shall be below 900 MHz, still better below 400 MHz and best of all be below 300 MHz.

A dielectric load has a dielectricity constant ($\epsilon$) and so called loss factor $\tan(\gamma)$. $\epsilon$ and $\tan(\gamma)$ are dependent of frequency f and of the kind of matter. It is an adopted practice to specify the heat generation in a matter with the expression:

$$E^2 \times \epsilon \times \tan(\gamma) \times f \times K$$

E stands for electric field strength. K is a constant.

The electric field strength is dependent of the dielectricity constant. A load with a dielectricity constant (ϵ) higher than the one for air located in an electric/electromagnetic field holds a field strength that is lower than the one in the surrounding air.

In the borderline between air and load there are field line patterns, which, if the load has a loss factor at applied frequency, cause local superficial overheating/s in the load.

In order to eliminate this kind of overheating/s the disturbing patterns of fields must be reduced or best of all eliminated. A prerequisite to reach now mentioned reduction or elimination is, that the difference between ( ) of the load 10 and ( ) of its surrounding material 24 is small. The ideal solution is characterized of an ( ) which is the same for the load 10 and for the surrounding material 24, simultaneously as the surrounding material 24 entirely had no tan( ). In these circumstances no local overheating will be possible to take place in those zones, where the material 24 and the load 10 adjoin each other.

In order to achieve requisite shielding effects in local parts of a load 10 a condition is, that at least 20% of the area 26 of the load 10 adjoins the above mentioned material 24, that still better at least 40% of the area of the adjoins the above mentioned material.

For the purpose of applying the principle of field levelling effectively the material surrounding a load has to be sufficiently thick.

The thickness of the material shall in average not be below 2 mm, still better not be below 5 mm and best of all not be below 8 mm.

The basis of this invention is that a dielectric load 10 having both and ( ) and a tan( ), wholly or partially is covered of a material 24, which merely has a dielectricity constant ( ). The material 24 in question may consist of one or more substances.

It has been confirmed that a necessary acceptable reduction of local overheating follows, if the dielectricity constant ( ) of the covering material exceeds 20% of the average ( ) of the load, still better exceeds 40% of the average ( ) of the load and best of all exceeds 60% of the average ( ) of the load.

However, there is no substance, which entirely lacks tan( ). In order to avoid an unwanted warming of material, which wholly or partially encloses the load, it has been shown in practice that the mean quantity of tan( ) at applied frequency/ies of the substance the said material consists of shall be below 75% of the mean quantity of the tan( ) of the load, still better below 50% of the mean quantity of the tan( ) of the load, and best of all below 25% of the mean quantity of the tan( ) of the load.

If a load with a surrounding material is located within an oscillating electric and/or electromagnetic field complicated disturbing field line patterns in the borderland between the material in question and the surrounding air arise. However, in the borderland between the load and the covering material the field line patterns are evened and thus local superficial warming is avoided.

There are certain applications where it may be favourable, if the load only partially is covered of a material, which eliminates or reduces superficial warming. For example if it is desirable to get additional warming of a particular part of a surface.

A low or non existing loss factor implies, that the energy loss in the material, which even the field lines in the surface layer of the load, becomes small or none.

An applicable solution of the problem to warm a load 10 consisting of one ore more substances is that the load 10 in a vessel 24, which is accordance with the invention holds above mentioned material, which in its turn surrounds the load 10 wholly or partially.

The vessel 24 with its load 10 is placed wholly or partially in an oscillating electric and/or electromagnetic field 16. The disturbing field line patterns, which earlier arose in the surface zones of the load, arise instead in the surface zones of the surrounding material.

This implies that the load can be warmed without any local overheating in the surface zones of the load.

A useful application is, that the vessel 24 consists of a tube and/or groove 28, wholly or partially filled with the above mentioned material. The load 10 is preferably in a liquid state. The tube/groove 28 are wholly or partially placed in the electric and/or electromagnetic field 16. The dielectric load 10 to be warmed is brought by way of the tube/groove 28 into and/or through the electric/electromagnetic field 16.

The complex disturbing field line patterns, which earlier arose in the surface layer of the load, arise instead in the surface of the above-mentioned material. This implies that the load can be warmed without local overheatings in its surface layer when passing through the material in the vessel.

There is also a need to control the warming of loads to particular zones. Thus the above mentioned material in the vessel can have instead of a homogeneous distribution an inhomogeneous distribution of (ϵ) and tan(γ).

An example of the invention is the warming of a bag filled with blood concentrate. The bag is placed in a vessel consisting of polyethylene plastic. In this case the load consisted of the blood concentrate with the enclosing bag. The vessel was filled with distilled water. An oscillating electric and electromagnetic field of the frequency 135 MHz supplied a power of about 500 W.

The bag with its content was warmed from 5° C. to 35° C. in a time less than 5 minutes without any blood cells being hurt.

A further example of warming was to get a blood concentrate/liquid to flow from a bag to receptacle outside the warming unit through a tube, which was extended through a vessel filled with distilled water. The vessel was placed in an oscillating electric /electromagnetic field. In this case the load consisted of that part of the tube, which was within the vessel including that part of the flowing blood concentrate the tube contained.

The invention claimed is:

1. An appliance having a heating antenna for generating an electromagnetic fields below 900 MHz, where the field/s is/are not generated in a resonant cavity, and said appliance comprising a dielectric load being placed in a dielectric material/s having a dielectric constant and a loss factor, an average dielectricity constant of this material/s shall, at applied frequency/ies, exceed 20% of an average dielectricity constant of the load, and the loss factor of this material/s shall, at the applied frequency/ies, be below 75% of an average loss factor of the load, and at least 20% of a surface of the load adjoining and being in contact with the mentioned dielectric material/s.

2. An appliance in accordance with claim 1, characterized by a thickness of the above mentioned material/s in the area/s being in contact with the load in average not being below 2 mm.

3. An appliance in accordance with claim 1, characterized by the load being placed in a vessel containing the above mentioned material/s.

4. An appliance in accordance with claim 3 characterized by sides of the vessel including the above mentioned material/s.

5. An appliance in accordance with claim 3 characterized by the vessel with load being placed wholly or partially in one or more oscillating electric and/or electromagnetic field/s.

6. An appliance in accordance with claim 3 characterized by the vessel being a tube and/or a groove containing the above mentioned materials and the load.

7. An appliance in accordance with claim 6 characterized by the tube/groove wholly or partially being placed in the electric and/or electromagnetic field/s.

8. An appliance in accordance with claim 1 characterized by the above mentioned material/s being preferably in a liquid state.

9. An appliance in accordance with claim 1 characterized by the dielectric load to be warmed being brought by way of a tube/groove into and/or through the electric and/or electromagnetic field/s.

10. A device having a heating antenna for generating an electromagnetic fields below 900 MHz, where the field/s is/are not generated in a resonant cavity, and said appliance comprising a load including a bag/container of blood being placed in a dielectric material/s having a dielectric constant and a loss factor, an average dielectricity constant of this material/s shall, at applied frequency/ies, exceed 20% of an average dielectricity constant of the load, and the loss factor of this material/s shall, at the applied frequency/ies, be below 75% of an average loss factor of the load, and at least 20% of a surface of the load adjoining and being in contact with the mentioned dielectric material/s.

11. A device in accordance with claim 10 characterized by a thickness of the above mentioned material/s in the area/s being in contact with the load in average not being below 2 mm.

12. A device in accordance with claim 10 characterized by the load being placed in a vessel containing the above mentioned material/s.

13. A device in accordance with claim 12 characterized by sides of the vessel including the above mentioned material/s.

14. A device in accordance with claim 12 characterized by the vessel with load being placed wholly or partially in one or more oscillating electric and/or electromagnetic field/s.

15. A device in accordance with claim 12 characterized by the vessel being a tube and/or a groove containing the above mentioned materials and the load.

16. A device in accordance with claim 15 characterized by the tube/groove wholly or partially being placed in the electric and/or electromagnetic field/s.

17. A device in accordance with claim 10 characterized by the above mentioned material/s being in a liquid state.

18. A device in accordance with claim 10 characterized by the dielectric load to be warmed being brought by way of a tube/groove into and/or through the electric and/or electromagnetic field/s.

19. A device in accordance with claim 10 characterized by the blood/liquid flowing to a receptacle through a tube extended through a vessel filled with the above mentioned material and the vessel wholly or partially in the electric and/or electromagnetic field/s.

* * * * *